US006360682B1

(12) United States Patent
Riemers et al.

(10) Patent No.: US 6,360,682 B1
(45) Date of Patent: Mar. 26, 2002

(54) SEA ANCHOR AND METHOD FOR ITS DEPLOYMENT

(75) Inventors: Mark Erik Riemers; Alex Kirstein, both of Woerden (NL)

(73) Assignee: Suction Pile Technology BV, Woerden (NL)

( * ) Notice: Subject to any disclaimer, the term of this patent is extended or adjusted under 35 U.S.C. 154(b) by 0 days.

(21) Appl. No.: 09/674,075

(22) PCT Filed: May 6, 1999

(86) PCT No.: PCT/NL99/00280

§ 371 Date: Oct. 26, 2000

§ 102(e) Date: Oct. 26, 2000

(87) PCT Pub. No.: WO99/57009

PCT Pub. Date: Nov. 11, 1999

(30) Foreign Application Priority Data

May 6, 1998 (NL) ..... 1009079
Feb. 12, 1999 (NL) ..... 1011293

(51) Int. Cl.[7] ..... B63B 21/27

(52) U.S. Cl. ..... 114/296

(58) Field of Search ..... 114/294, 293, 114/296, 295; 405/227, 228

(56) References Cited

U.S. PATENT DOCUMENTS

| | | | |
|---|---|---|---|
| 3,866,368 A | 2/1975 | Toops | |
| 4,312,289 A | 1/1982 | Conrad | |

FOREIGN PATENT DOCUMENTS

| | | | |
|---|---|---|---|
| NL | 8 101 640 | 11/1982 | |
| SU | 1776607 | * 11/1992 | ..... 114/296 |
| WO | WO 98/52819 | 11/1998 | |

* cited by examiner

*Primary Examiner*—Ed Swinehart
(74) *Attorney, Agent, or Firm*—Young & Thompson

(57) ABSTRACT

A combination of an installation device and a sea bottom anchor is adapted to install the anchor (1) into the subsea bottom by means of suction pressure. The anchor has one or more anchoring amplification members that can be brought into an active position from an inactive position to increase the anchoring capacity of the installed anchor.

12 Claims, 5 Drawing Sheets

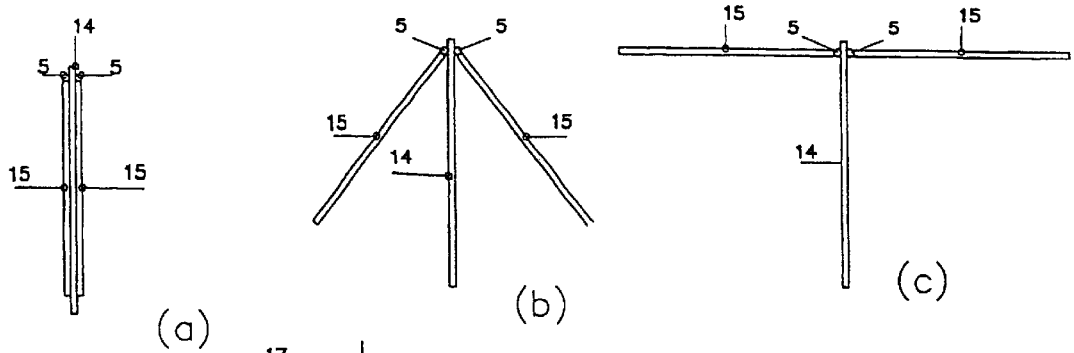
fig 7 (a,b,c)
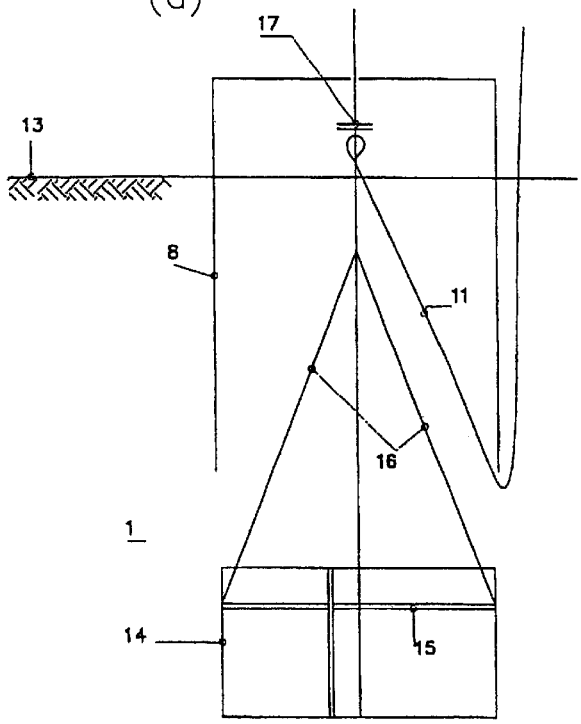
fig 6e
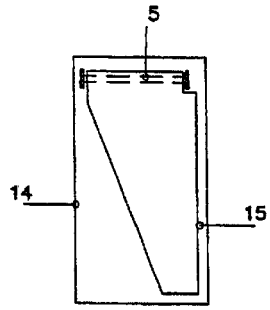
fig 8
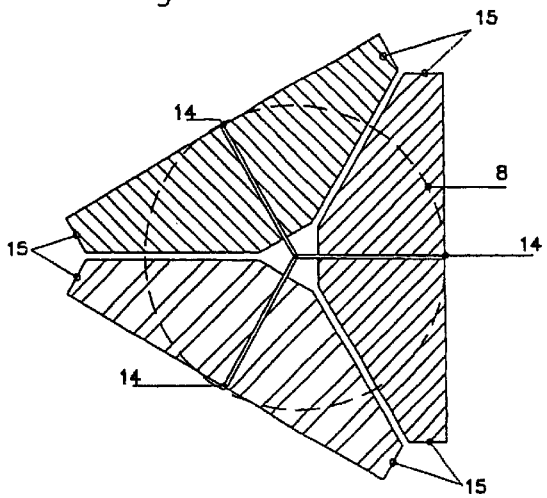
fig 9

SEA ANCHOR AND METHOD FOR ITS DEPLOYMENT

BACKGROUND OF THE INVENTION

The invention is concerned with a marine structure. In particular it is concerned with installing, particularly with suction force e.g. generated by a so called suction pile, and the design of an anchoring body in the subsea bottom. The invention is both relative to the anchoring body and the installing device and the combination of both and is also relative to the method of installing.

With this anchoring body horizontal and/or vertical loads can be taken up from an object to be anchored in or above the subsea bottom, such as an oil production platform floating in or on the water or a vessel or a mooring buoy for a vessel or a subsea pipe line. The anchoring body can be part of a plurality of horizontal spaced anchoring bodies provided within the soil and from each of which an anchoring line extends upward to a floating object, such as an oil production platform (a so called tension-leg platform; viz. e.g. WO96/40548, incorporated here by reference). The anchoring body can be integrated with the installing device, or be coupled therewith in a easily disengageable manner.

The design and installation of an anchoring body with the aid of a suction pile is e.g. described in WO98/52819 and in GB-A-2317153 (corresponding to the British patent application, filing number 19960001894, titled "A Subsea Mooring", in the name of Karel Karal), both incorporated here by reference. Both describe coupling of the anchor and the suction pile on a ship deck above seal level, lowering the combination onto the subsea bottom, sucking in of the upright suction pile into the subsea bottom such that the upright anchor completely disappears into the subsea bottom and therewith is completely embedded by the subsea bottom, disengaging the anchor from the suction pile and pressing the suction pile upward from the subsea bottom by internal over pressure to relocate it onto the ship deck. The anchor is coupled to a flexible anchor line extending therefrom until above the subsea bottom. This anchor line follows such a path through the subsea bottom and the water there above, that this is exclusively adapted to transmit a horizontal load onto the anchor. Since the anchor is separate from the suction pile it is possible to install the suction pile completely below the subsea bottom.

Suction piles and their way of installing are o.a. known from GB-B2300661 and EP-B-0011894, which disclosures are incorporated here by reference. Briefly, a suction pile is a thin walled steel cylinder, closed at at least one longitudinal end, that is located on the subsea bottom with the opposite end and penetrates the subsea bottom with the aid of a suction created within the cylinder. The creation of the suction can be with the aid of a suction source, such as a pump, being on, or close to or at a distance (e.g. above the water surface, e.g. at a vessel) from the suction pile. The applied level of the suction can be e.g. at least substantially constant, smoothly increase or decrease or else pulsate; for which there are convenient means; for an e.g. pulsating level a possibly in the suction pile integrated pressure accumulator that is After use, the suction pile can easily be removed by creating an overpressure within the cylinder, e.g. by pumping in (sea) water.

SUMMARY OF THE INVENTION

According to one aspect installing is concerned of an in embedding-direction profiled anchoring body, i.e. a body that is preferably not flat sheet like as viewed in embedding direction, but shows more of e.g. a wave or bulge, or is preferably assembled from mutually angularly connected parts, or has an in itself closed shape, such as a ring shape, wherein said shape is preferably adapted such that said body gets support from the inner wall of the suction pile and/or the lower side of the suction pile or the suction pile requires no additional implements to at least tilting free holding said anchoring body. In this manner it is e.g. not necessary that the anchoring body penetrates the sideway boundaries of the suction space substantially, which e.g. results in an at its lower side diametrically oppositely over about half the height of the anchor notched suction pile with a notch width about equal to the anchor plate thickness. It is also e.g. not necessary in that sense that the suction pile penetrates the anchoring body with e.g. a boundary from above.

In one aspect the concern is the installing of the anchoring body in the subsea bottom wherein the body remains at least substantially fixed in position, this contrary to the known installing wherein after bringing to a convenient depth into the subsea bottom, the body experiences tilting, e.g. by pulling thereon via a so called bridle, to become active.

In one aspect the concern is to give the anchoring body the desired configuration within the subsea bottom by means of a tension or compression force provided by e.g. the suction pile during its pressing out the subsea bottom. E.g. a wedge is activated or an extendable part is extended by it, from which the anchoring body gets its anchoring power at least partly, preferably at least substantially.

BRIEF DESCRIPTION OF THE DRAWINGS

The invention is characterised by the attached claim 1.

The invention is further illustrated with the aid of at the moment advantageous, non-limiting embodiments. The drawings show in:

FIG. 4*a* and *b* in side view. FIG. 4*c* end *d* in perspective;

FIGS. 6*a–e* a prespective view of several subsequent steps during installing the anchor of FIG. 5;

FIGS. 7*a–c* a detail view of three subsequent positions of the anchor of FIG. 5;

FIG. 8 a detail view of the anchor of FIG. 5; and

FIG. 9 a top view of the anchor of FIG. 5 in its final position.

DETAILED DESCRIPTION OF THE PREFERRED EMBODIMENTS

Figure 1:
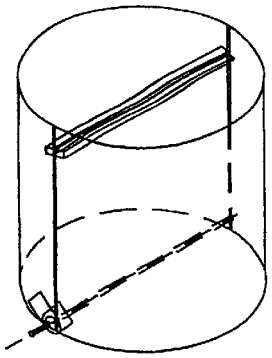
FIG. 1 a perspective view of a first embodiment of the anchor.
Figure 2:
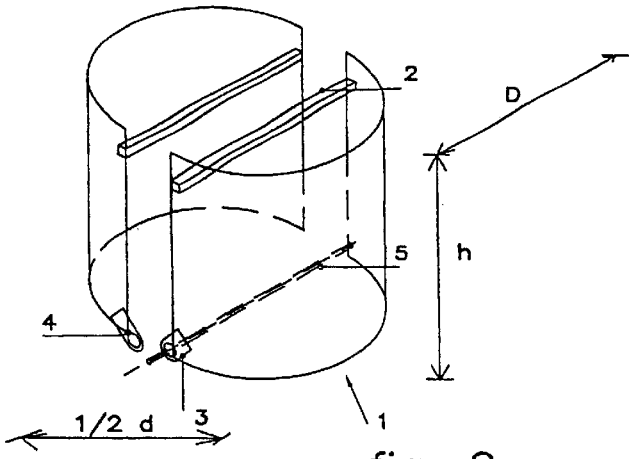
FIG. 2 the exploded view of FIG. 1.

FIGS. 1 and 2 show a cylindrical anchor 1 of steel, open at the top and bottom side. It has a diameter of 6 m and a height of 2 m. It consists of two shell halves pivotably connected mutually at the lower side by a diametrically extending pin 5 connecting the pivot lips 3 and 4. The longitudinal edges of each shell half are bridged by a pulling member 2, in this case a steel section.

Figure 3:
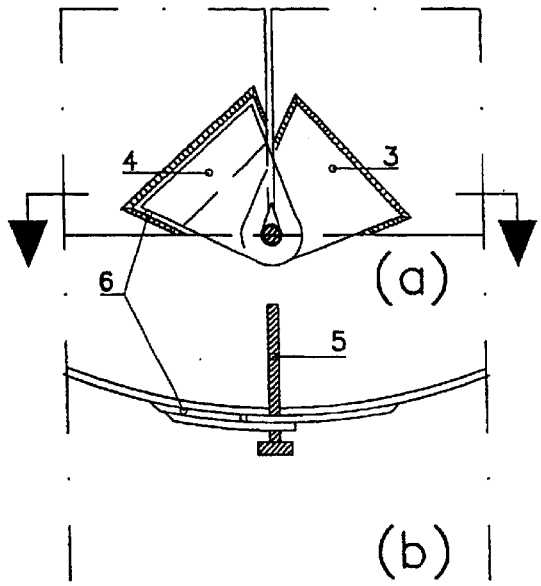
FIG. 3*a* and *b,* a detail in side view and sectional view, respectively.

FIG. 3 shows the pivotal connection more in detail. Below the pivot lip 4 there is the filling plate 6. The pivot lip 4 overlaps the pivot lip 3.

Figure 4C:
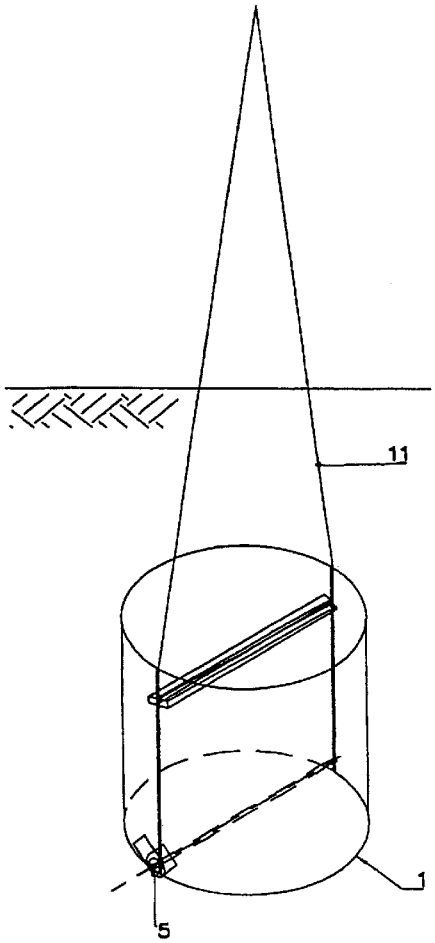
FIGS. 4*a–d* several subsequent steps during installing the anchor of FIG. 1.
Figure 4D:
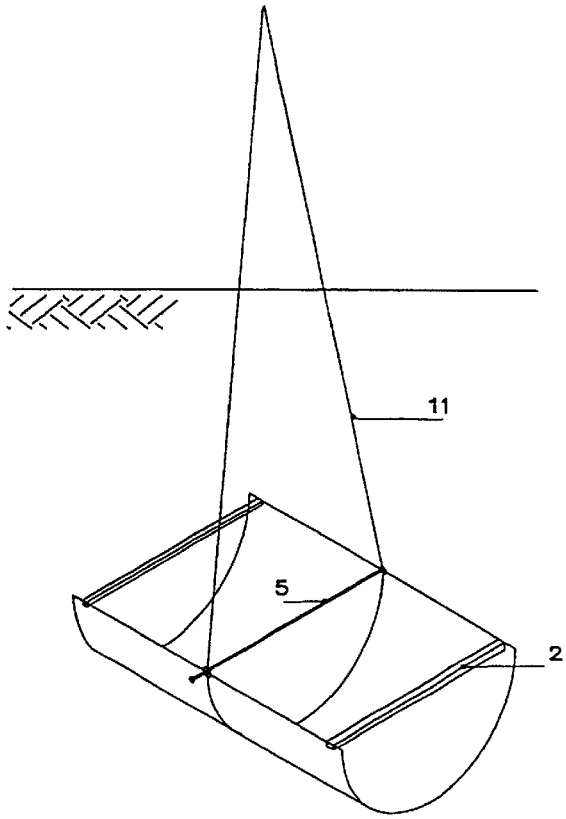
Figure 4A:
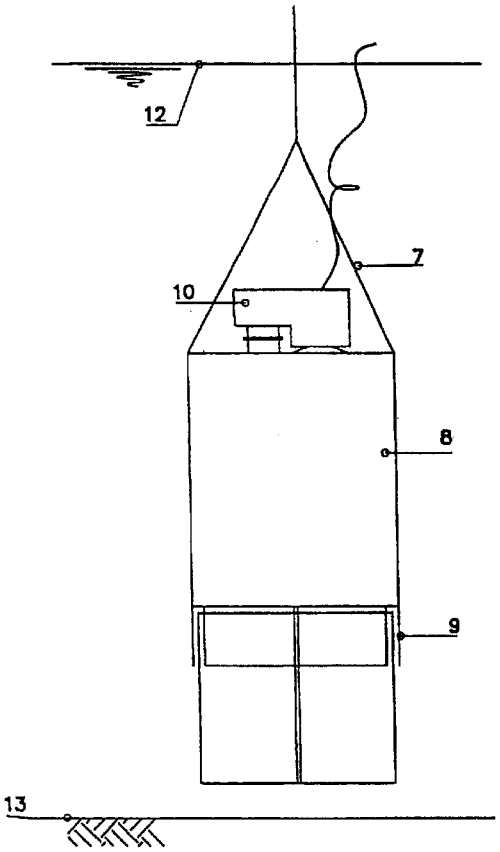
Figure 4B:
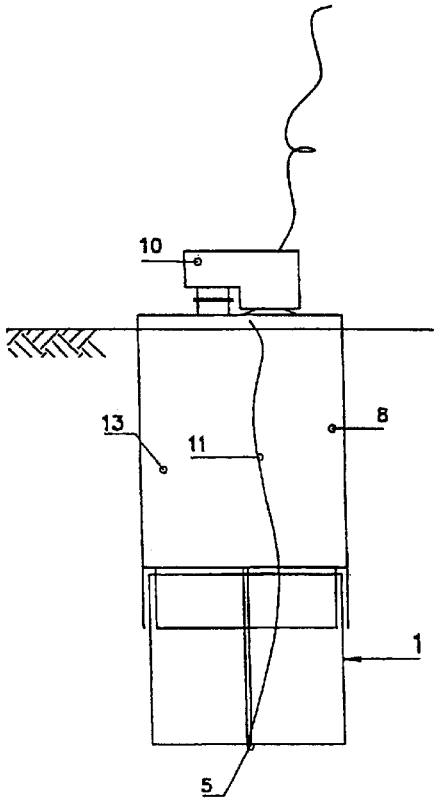

In FIG. 4*a* the anchor 1 is suspended under a suction pile 8 below the water surface 12. The suction pile 8 is suspended from vessel (not shown) by a hoisting cable 7. Above the suction pile 8 there is the pump unit 10 to generate suction and over pressure, respectively, within the suction pile during installing within the subsea bottom 13. The connection of the anchor 1 to the suction pile 8 is air and water tight by the coupling 9. At both sides of the anchor 1 a flexible pulling member 11, extending upward outside the anchor 1 and the suction pile, is fixed (FIG. 4*b*) to the pivot pin 5. The suction pile 8 is subsequently lifted, while the anchor 1 is left behind. By vertically pulling on the members 11 (FIG. 4*c*) the shell halves pivot towards the open position around the pin 5. The anchor 1 remains completely below the subsea bottom during this. The capacity of the anchor to resist vertical loads is substantially increased now.

The shell halves of the anchor 1 of FIG. 1 can be provided with stiffeners for increased shape stability. For automatic extension a shell half can be fixed to pivot around a pivot axis that is provided such that when pulling at the anchoring body in the direction opposite the direction in which it is inserted in the subsea bottom, the shell half tries to further pivot open. The pivot axis is e.g. provided at a low level at the anchoring body, based on the retracted position of the shell half. The shell half can have a shape that differs from the cylindrical shape. The anchor 1 can be e.g. provided by two flat plate members, at their lower sides mutually connected to pivot over a limited angle. When in the retracted position, these members are bearing flat against each other. Once inserted in the subsea bottom, they can be brought in the extended position by e.g. pulling such that each can pivot over an angle of 90° to arrive in a mutually registered position.

Figure 5:
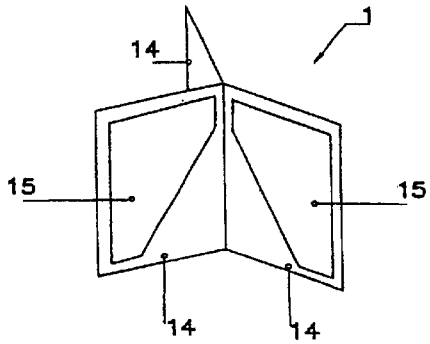
FIG. 5*a* perspective view of a second embodiment of the anchor.
Figure 6C:
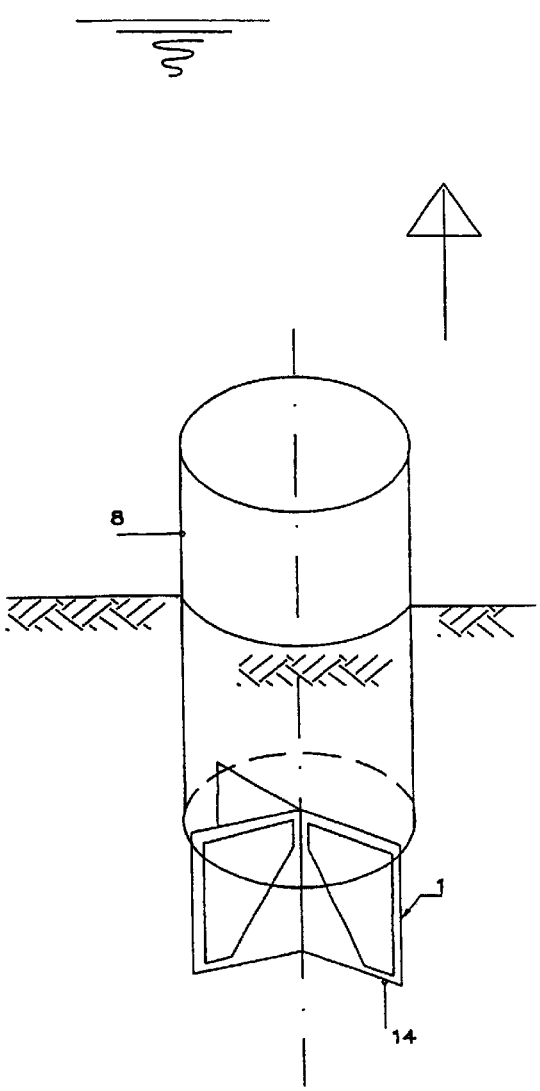
Figure 6D:
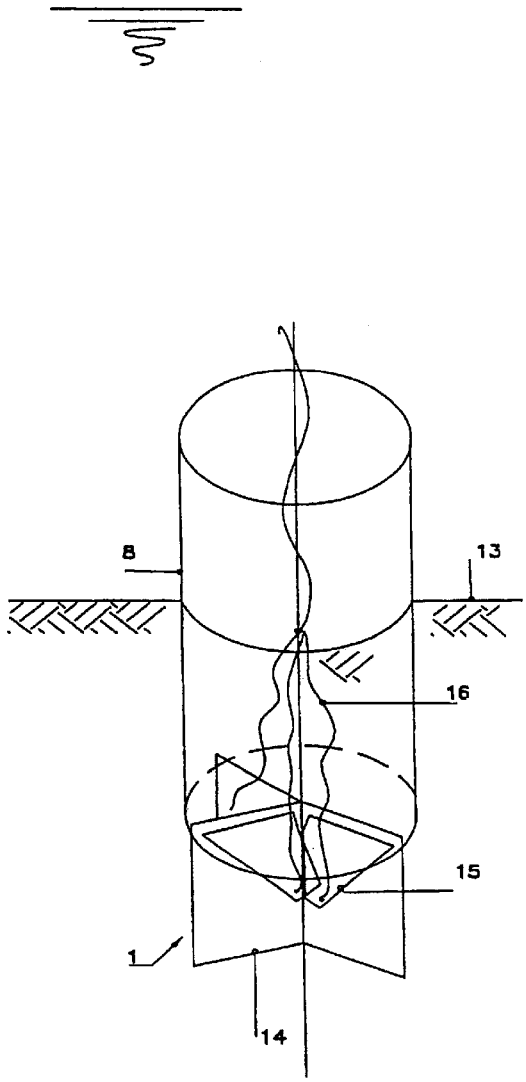

FIG. 5 shows an anchor 1 that has a star shape in top view. Each of the three plate shaped arms 14 has at both sides an extendable flap 15 pivotably connected at its upper side to the arm 14.

FIG. 6 shows how this anchor 1 can be completely embedded within the suction space of a suction pile 8. The anchor 1 preferably finds support at all sides against the inner side of the suction pile 8. The anchor can also project slightly from below the suction pile 8. It preferably projects such below the suction pile, that the suction pile still can connect to the subsea bottom 13 in an air and water tight manner. This amount of projection can depend on the type of subsea bottom. The weaker the bottom, the greater the self penetration of the suction pile and thus the more the anchor can project from below the suction pile. Thus an air and water tight coupling between the anchor 1 and the suction pile 8 is not required.

After sucking in to the desired depth (FIG. 6*b*) the anchor 1 is completely under ground. The suction pile 8 is lifted now (FIG. 6*c*), while the anchor is left behind.

Figure 6A:
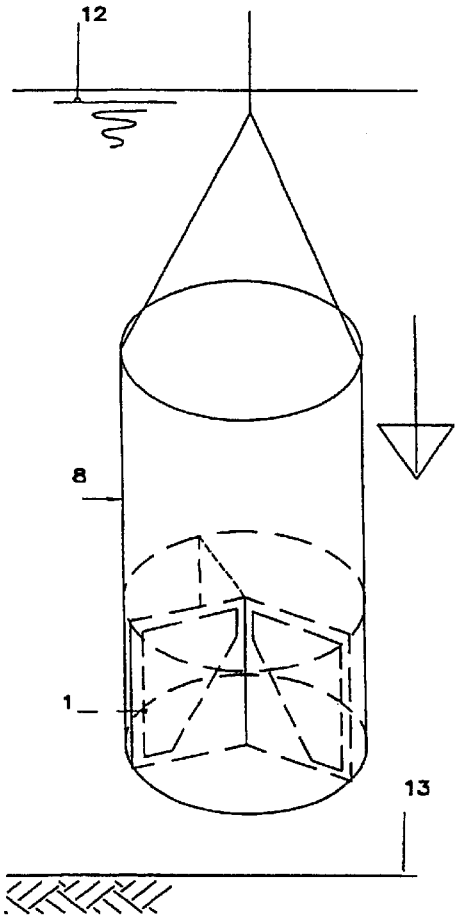
Figure 6B:
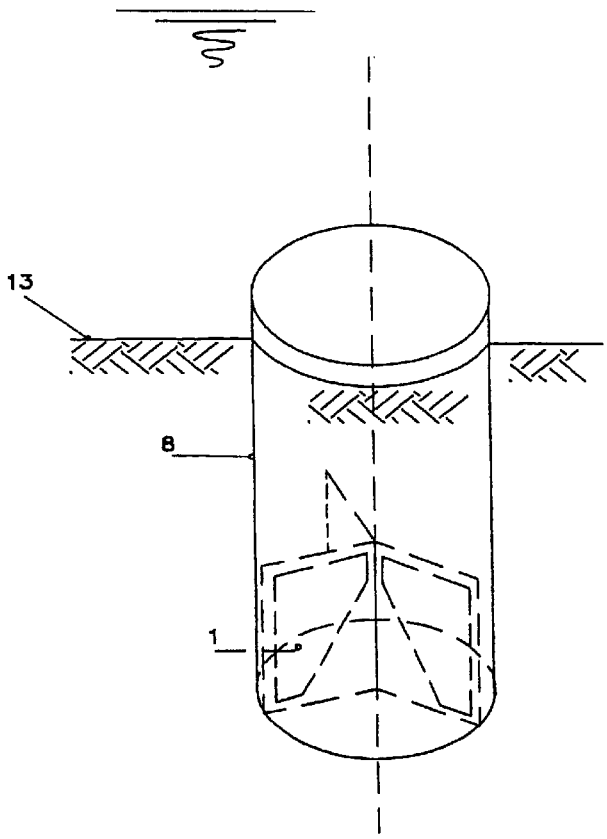

During sucking in the flaps 15 must be extended in their active position. This can be done by fixing (FIG. 6*d*) a flexible pulling member 16 to each flap 15 with which the flaps can be extended. Those members 16 are e.g. fixed to the suction pile 8. While lifting the suction pile 8, the members are automatically pulled at. Those members 16 are e.g. temporarily fixed to the suction pile 8, e.g. through a breach coupling 17 (FIG. 6*e*). As soon as the flaps 15 are conveniently extended, the connection to the suction pile 8 is disconnected and the suction pile is lifted alone and hoisted on board of the vessel again. The object to be anchored can now be coupled to the anchor line 11. The anchor line 11 can be fixed to the members 16.

Another possibility for extension is as follows: During sucking in, the flaps 15 are released for extension if the anchor 1 is already brought into the subsea bottom over a predetermined depth. By sucking in further the flaps 15 open now automatically. With the aid of an arresting mechanism they can be fixed in the extended position. Release for extension can be provided by allowing a mutual displacement between the anchor and the suction pile during insertion, e.g. by intermediate upward movement of the suction pile while the anchor remains behind in the soil, such that a latch mechanism is activated. In stead of a mutual displacement it is also feasible to temporarily decrease or remove the load of the suction pile on the anchor, to realise the desired release.

The flaps 15 are initially in a retracted position (FIG. 7*a* and 8). Subsequently they are extended (FIG. 7*c*). If all flaps 15 are extended, the top view of the anchor 1 according to FIG. 9 is arrived at.

The suction pile 8 preferably has convenient arresting means therefor, to fix the anchor 1 with respect to the suction pile 8, e.g. to prevent that during penetrating the subsea bottom 13 by the suction pile 8, the anchor 1 displaces with respect to the suction pile 8 and/or to provide that during e.g. manipulating, the anchor 1 remains in position with respect to the suction pile 8, e.g. does not slide outward with respect to the suction pile 8.

In the following further possible features of the invention are mentioned.

The anchoring body is e.g. at least substantially sheet type, e.g. in top view star shaped (i.e. profiled as viewed in the direction of inserting) with three or more beams/arms. The anchoring body is preferably provided with coupling means for coupling at least one preferably supple anchoring member for mounting to the object to be anchored. The anchoring body is preferably provided with an anchoring amplifying means such as a convenient member that can be oriented perpendicular to the expected orientation of the pulling force, wherein said means can preferably be activated, e.g. is extendable, during or after providing the anchoring body into the subsea bottom, e.g. by a convenient, preferably remotely or automatically actuatable actuating means provided e.g. at the anchoring body and/or the suction pile. Activation e.g. takes place by moving the suction pile upward, e.g. after the anchoring body is brought at the desired depth within the subsea bottom. Activation e.g. takes place by actuation of a release means during an end phase of the sucking in, e.g. by intermediate preferably partly pressing or pulling out the suction pile from the subsea bottom, after which further sucking in takes place. During said further sucking in said activation (e.g. extension) e.g. takes place, e.g. in that the anchoring amplifying means is hingedly connected at its top side. The anchoring body is e.g. provided with at least one anchoring amplifying means extendably mounted thereto, having an enlarged supporting area, as viewed in the expected pulling direction, if in the extended position, wherein said supporting area is possibly larger than the inside diameter of the cross sectional area, as viewed in the direction of insertion, of the suction pile with which the installation takes place. With the aid of a detection means, e.g. an angle measuring means e.g. integrated in the pivoting element of the anchoring amplifying means or any other extendable element at the anchoring body, monitoring the extension is possible. With the aid of securing means the extended element can be secured in its extended position. A supple pulling means extends e.g. between the anchoring amplifying means and the suction pile such that during upward moving of the suction pile the anchoring amplifying means is activated. The activating means is preferably mounted to the suction pile with the aid of a frangible connection, such as a break pin or explosion pin, wherein said frangible connection is preferably of the automatic type, breaking when predetermined requirements during installing are fulfilled. With respect to that the frangible connection is e.g. strong enough such that the suction pile can pull at the anchoring amplifying body to activate it, but too weak to move, such as displace, particularly pulling from the subsea bottom, the anchoring body by pulling of the suction pile at the anchoring body with activated anchoring amplifying means. If a frangible connection of the forced type is used, e.g. an explosion pin, it is prefered, to activate the frangible means remotely, for which the frangible means is e.g. coupled to a receiver of a transmitter/receiver assembly. The activation means is preferably combined with the anchoring member or the coupling means for it, wherein the activation means is e.g. extended by the anchoring member or is integrated therewith.

The invention is also concerned with the combination of a feature/aspect indicated here, separated from possible features/aspects here indicated in combination therewith, with one or more other features/aspects indicated here, seperated from possible features/aspects here indicated in combination therewith.

What is claimed is:

1. A combination of an anchor and an installation device for installing the anchor in a sea bottom, wherein:

the installation device is arranged and adapted to urge the anchor into the sea bottom upon application of a suction;

the anchor comprises an anchor amplifying member that includes at least one shell half that is movable between an active position and an inactive position; and the anchor and the installation device are separate components that are temporarily connected to each other.

2. The combination of claim 1, wherein the anchor is connected to the installation device until the installation device is withdrawn from the sea bottom, the installation device being arranged and adapted to separate from the anchor and leave the anchor in the sea bottom.

3. The combination of claim 1, wherein the anchor amplifying member comprises two of the shell halves that are pivotally connected to each other about an axis.

4. The combination of claim 3, wherein the two shell halves are each pivotable over 90°.

5. The combination of claim 3, further comprising a pulling member attached to the axis for moving the anchor amplifying member to the active position.

6. The combination of claim 3, wherein the anchor amplifying member is cylindrical when in the inactive position and is semi-cylindrical in the active position.

7. The combination of claim 1, wherein said installation device comprises a hollow body with one open end and one closed end to which a source of the suction is attached.

8. The combination of claim 7, wherein the anchor is at least partly enclosed within the hollow body while the installation device and the anchor are temporarily connected.

9. The combination of claim 7, wherein the anchor is at least partly within the open end of the hollow body while the installation device and the anchor are temporarily connected and further comprising an air and watertight coupling between the anchor and the hollow body.

10. A combination of an anchor and an installation device for installing the anchor in a sea bottom, wherein:

the installation device comprises a hollow body with one open end and one closed end to which is attached a source of suction, the installation device urging the anchor into the sea bottom upon application of suction from the source of suction;

the anchor comprises an anchor amplifying member that includes two shell halves that are pivotally connected to each other about an axis and movable from an inactive position in which the two shell halves are together with one end at least partly within the hollow body to an active position in which the two shell halves are pivoted apart by application of a pulling force to the axis; and the anchor and the installation device are separate components that are temporarily connected to each other until the installation device is withdrawn from the sea bottom, the installation device being arranged and adapted to separate from the anchor and leave the anchor in the sea bottom.

11. The combination of claim 10, wherein the axis of the two shell halves is at an end of the anchor amplifying member opposite to the one end within the hollow body.

12. The combination of claim 10, wherein the anchor amplifying member is cylindrical when in the inactive position and is semi-cylindrical in the active position.

* * * * *